US008585890B2

(12) United States Patent
Wang et al.

(10) Patent No.: US 8,585,890 B2
(45) Date of Patent: Nov. 19, 2013

(54) TUBULAR CRACKING FURNACE

(75) Inventors: Guoqing Wang, Beijing (CN); Lijun Zhang, Beijing (CN); Zhiguo Du, Beijing (CN); Shuo Chen, Beijing (CN); Zhaobin Zhang, Beijing (CN); Cong Zhou, Beijing (CN); Xianfeng Zhou, Beijing (CN)

(73) Assignees: China Petroleum & Chemical Corporation, Beijing (CN); Beijing Research Institute of Chemical Industry, China Petroleum & Chemical Corporation, Beijing (CN)

( * ) Notice: Subject to any disclaimer, the term of this patent is extended or adjusted under 35 U.S.C. 154(b) by 842 days.

(21) Appl. No.: 12/593,216

(22) PCT Filed: Mar. 28, 2008

(86) PCT No.: PCT/CN2008/000626

§ 371 (c)(1),
(2), (4) Date: Mar. 2, 2010

(87) PCT Pub. No.: WO2008/116397

PCT Pub. Date: Oct. 2, 2008

(65) Prior Publication Data

US 2010/0147672 A1 Jun. 17, 2010

(30) Foreign Application Priority Data

Mar. 28, 2007 (CN) ..... 2007 1 0064886

(51) Int. Cl.
*C10G 9/14* (2006.01)
*B01J 8/00* (2006.01)

(52) U.S. Cl.
USPC ..... 208/132; 202/222; 202/265; 422/641; 422/645; 422/651; 422/652; 422/659

(58) Field of Classification Search
USPC ..... 208/132; 585/652; 165/181, 182, 183, 165/184, 179; 422/198, 201, 205, 641, 645, 422/651, 652, 659; 202/222, 265
See application file for complete search history.

(56) References Cited

U.S. PATENT DOCUMENTS

| | | | |
|---|---|---|---|
| 5,950,718 | A | 9/1999 | Sugitani et al. |
| 6,484,795 | B1 | 11/2002 | Kasprzyk |

(Continued)

FOREIGN PATENT DOCUMENTS

| | | |
|---|---|---|
| CN | 1093250 | 10/2002 |
| CN | 1133862 | 1/2004 |
| CN | 1766042 | 5/2006 |
| FR | 2436959 | 4/1980 |
| JP | 6-3075 | 1/1994 |

OTHER PUBLICATIONS

International Search Report for International Application No. PCT/CN2008/000626, mailed Jun. 26, 2008.
English language Abstract of CN 1766042, May 3, 2006.
English language Abstract of FR 2436959, Apr. 18, 1980.
English language Abstract of JP 6-3075, Jan. 11, 1994.

*Primary Examiner* — Nina Bhat
(74) *Attorney, Agent, or Firm* — Finnegan, Henderson, Farabow, Garrett & Dunner, LLP

(57) ABSTRACT

This invention relates to a tubular cracking furnace, especially an ethylene cracking furnace, which comprises a convection section and a or dual radiant section(s), at least one heat transfer intensifying member arranged in at least one pass each radiant tube in said radiant section, said at least one heat transfer intensifying member comprises a first heat transfer intensifying member, which is arranged at a location between 10D and 25D upstream of the extreme point of said at least one pass radiant tube metal temperature, wherein D is the inner diameter of the radiant tube having heat transfer intensifying members. The present invention could achieve the best enhanced heat transfer result with given number of heat transfer intensifying member, by optimizing the locations of heat transfer intensifying members in the radiant tube.

22 Claims, 5 Drawing Sheets

(56) References Cited

U.S. PATENT DOCUMENTS 6,530,422 B2 3/2003 Zhu et al.
7,004,085 B2 * 2/2006 Platvoet et al. ..... 110/203
7,128,139 B2 * 10/2006 Oballa et al. ..... 165/181
7,637,012 B2 * 12/2009 Thors et al. ..... 29/890.049
7,799,963 B2 * 9/2010 Inui et al. ..... 585/652
7,963,318 B2 * 6/2011 Wolpert et al. ..... 165/184
7,964,091 B2 * 6/2011 Barendregt et al. ..... 208/132
8,302,307 B2 * 11/2012 Thors et al. ..... 29/890.05

* cited by examiner

TUBULAR CRACKING FURNACE

FIELD OF THE INVENTION

The present invention relates to a tubular cracking furnace, especially to a method for arranging heat transfer intensifying members in the ethylene cracking furnace, and a tubular cracking furnace using the method.

BACKGROUND OF THE INVENTION

The pyrolysis of hydrocarbons is performed in a tubular cracking furnace industrially. As well known, theoretically the chemical reaction of the pyrolysis of hydrocarbons is a strong endothermal reaction, including a primary reaction and a secondary reaction. General speaking, the primary reaction relates to reactions in which big hydrocarbon molecules become smaller molecules, i.e., linear hydrocarbons are dehydrogenated and chain broken, and naphthene and arene are dehydrogenated and ring broken, thus ethylene and propylene and the like are produced in the primary reaction. The secondary reaction relates to reactions in which the products of the primary reaction, namely, olefins and alkynes, are performed to polymerization, dehydrogenating condensation, as well as naphthenes and aromatics are performed to dehydrogenating condensation and dehydrogenating fused cyclization and so on. The secondary reaction would not only greatly decrease the yield of target products, but also produce coke seriously. The coke would deposit on the inner wall of radiant tube. The formation of coke on the inner wall of the radiant tube is greatly disadvantageous for the regular operation of cracking furnace. The coke adhered on the inner wall of the radiant tube would increase heat conducting resistance and stream resistance of reactant fluids in whole reactive system. The increase of both heat conducting resistance and stream resistance will be against primary reaction.

Industrially, cracking furnace decoking has to be performed periodically due to the coking on cracking furnace. The interval between decoking is called "run length". Usually, at the end of the every "run length", due to the coke layer, tube metal temperature (TMT for short) would tend to exceed the maximum (generally 1125° C.) of tube material requirement.

Therefore, it will help to lengthen the "run length" and increase the cracking furnace's processing load, if the coking in the cracking furnace is suppressed. To suppress coking, it is necessary to decrease the secondary reaction as much as possible while maintaining the primary cracking reaction in radiant tube. Therefore, it should be avoided to unnecessarily heat the product of the primary reaction above the highest temperature of cracking temperature range and to retain excessive reaction time in the radiant tube. In addition, a contrary restrict factor is that lower pressure is helpful for the primary reaction, since pyrolysis is a reaction of volume increasing.

Chinese patent CN1133862C discloses a twisted-tape tube (please see attached FIGS. 4 and 5), wherein said twisted-tape tube is arranged in the radiant tube at regular intervals. The operating principle of "twisted-tape tube" could be described briefly as follows: As is well known, heat transfer process of radiant section in ethylene cracking furnace may include following steps. At first, the gas inside hearth transfers heat into the outer wall of radiant tube through radiation and convection, and then the outer wall transfers heat to inner wall and the likely existent coke layer by wall heat conduction, finally heat is transferred to internal fluid from inner wall by convection. According to the boundary layer theory of Prandtl, when the fluids flow along a solid wall surface, a thin fluid layer near the wall surface will be adhered on the tube wall surface without slipping, thus a flowing boundary layer is formed. Because the boundary layer transfers heat by conduction, its heat resistance is very high although the boundary layer is very thin. Then heat is transferred to the center of turbulent flow through the boundary layer by convection. According to above analysis, the most resistance of tube heat transfer is on the boundary layer and the coke layer adhered on tube inner wall surface. If the resistance by the boundary layer could have been reduced, heat transfer efficiency will be greatly intensified. The twisted-tape tube in CN1133862C is developed base on such principal. The twisted-tape tube arranged in the radiant tube will force to change fluids flow from plug flow to turbulent flow. Thereby the fluids will have a strong traversing flush effect on the tube wall, thus the boundary layer will be destroyed and got thinner. As a result heat transfer resistance nearby flowing boundary layer is decreased, and heat transfer efficiency is intensified.

In this invention the "twisted-tape tube" and related members are all called with general name of "heat transfer intensifying member", this term refer to all members arranged in the radiant tube that be able to force to change fluids from plug flow to turbulence flow and thus to destroy and thin the boundary layer. It is not only restricted to "twisted-tape tube".

Although heat transfer between radiant tube and inner fluids could be intensified by arranging twisted-tape tube and alike member, it does not necessarily mean the more the better. The reason is that, when the members are arranged in the radiant tube, the pressure drop would be increased accordingly in tube. Also as mentioned above, the pressure drop increase is adverse to perform the cracking reaction.

Therefore considering tube pressure drop, the twisted-tape tube could not be arranged as more as possible. This invention is to address this confliction, i.e. to arrange certain number of twisted-tape tubes to maximize heat transfer and restrain coking at the farthest, thus to greatly enhance processing load and extend run length before decoking.

SUMMARY OF THE INVENTION

The present invention provide a tubular cracking furnace, especially an ethylene cracking furnace comprising a convection section and a or dual radiant section(s), at least one heat transfer intensifying member arranged in at least one pass radiant tube in said radiant section. Said at least one heat transfer intensifying member comprises a first heat transfer intensifying member, which is arranged at a location between 10D and 25D upstream of the extreme point of said at least one pass radiant tube metal temperature, wherein D is the inner diameter of the radiant tube having heat transfer intensifying members.

Preferably, said at least one heat transfer intensifying member further comprises a second heat transfer intensifying member, which is arranged downstream of the first heat transfer intensifying member, with a distance less than Y, maximum affected distance of said first heat transfer intensifying member, preferably arranged between 0.7Y and 1.0Y.

Preferably, said at least one heat transfer intensifying member comprises a third heat transfer intensifying member, which is arranged downstream of the second heat transfer intensifying member, with a distance less than Y, maximum affected distance of said second heat transfer intensifying member, preferably arranged between 0.7Y and 1.0Y.

Preferably, said at least one heat transfer intensifying member comprises a fourth heat transfer intensifying member, which is arranged after the third heat transfer intensifying member, with a distance less than Y, maximum affected distance of said third heat transfer intensifying member, preferably arranged between 0.7Y and 1.0Y.

Preferably, said heat transfer intensifying member is a twisted-tape tube. Preferably, the twist ratio of said twisted-tape tube is between 2 and 3, the twisted tape has a twisted angle of 180°.

Preferably, said Y is between about 50D and 60D.

Preferably, said radiant tube is type 2-1 or type 4-1.

Preferably, said radiant tube is type 2-1, said first, second, third and fourth heat transfer intensifying members are twisted-tape tubes and only arranged in the second pass tube.

Preferably, said radiant tube is type 2-1, said first, second, third and fourth heat transfer intensifying members are twisted-tape tubes and arranged in the first and second pass tubes, respectively.

Preferably, said radiant tube is type 4-1, said first, second, third and fourth heat transfer intensifying members are twisted-tape tubes and only arranged in the second pass tube.

Preferably, said radiant tube is type 4-1, said first, second, third and fourth heat transfer intensifying members are twisted-tape tubes and arranged in the first and second pass tubes, respectively.

The present invention has following advantages:

1. The present invention could achieve the best enhanced heat transfer result with given number of heat transfer intensifying members, by optimizing the locations of heat transfer intensifying members in the radiant tube.

2. Because of the addition of heat transfer intensifying members such as twisted-tape tube to the radiant tube, the heat transfer boundary layer is thinned and the thermal resistance is decreased. Thus, the method according to the present invention could greatly improve heat transfer efficiency of ethylene cracking furnace and minimize coking inclination, therefore, the processing load of the ethylene cracking furnace is enhanced and the run length is extended.

3. By using the ethylene cracking furnace of the present invention and relying on its own potency of conventional furnaces, the ethylene cracking furnace could enhance its processing load by 5%~7% and extend run length by 30%~100%.

MODE OF CARRYING OUT THE INVENTION

Figure 5:
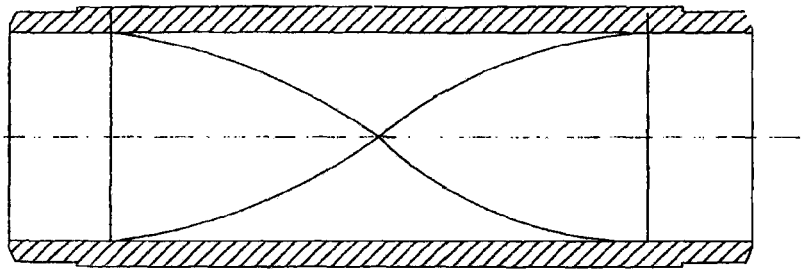
FIG. 5 shows a vertical section of the twisted-tape tube used in the method of the present invention.
Figure 6:
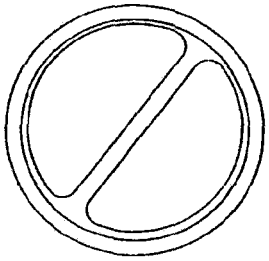
FIG. 6 shows a traverse section of the twisted-tape tube used in the method of the present invention.

The heat transfer intensifying members in the present invention may use the "twisted-tape tube" in CN1133862C, as shown in FIGS. 5 and 6. The twisted ratio (which is the ratio of the axial length of the twisted-tape tube with a twisted angle 180° vs the inner diameter) is preferably 2 to 3, it is 2.5 in the embodiments. The heat transfer intensifying members arranged in the radiant tube could direct the in-process materials flowing forward helically other than straight ahead, so that the in-process materials passing through inside twisted-tape tube strongly flush the inner surface of the twisted-tape tube tangentially. And thereby, the thickness of the boundary layer on the inner surface of twisted-tape tube are destroyed and become much thinner, so that the heat resistance nearby the flowing boundary layer is much smaller. Therefore, the heat transfer efficiency of twisted-tape tube could be increased.

Before the in-process materials in the radiant tube pass through the surface of twisted-tape tube, the in-process materials flow in plug flow type, the tangential speed of which is almost zero; immediately after the in-process materials flow through twisted-tape tube, the flow type of the in-process materials is changed abruptly, and the tangential speed of the in-process materials increases rapidly. After the in-process materials pass the twisted-tape tube, the tangential speed of the in-process materials is falling off and trending down till zero along the axial direction of the tube. The term "maximum affected distance" of the twisted-tape tube means the distance of the radiant tube calculated from the point that the in-process materials begin flowing through twisted-tape tube to the point that the tangential speed of the in-process materials becomes zero again. As for the twisted-tape tube with twisted ratio of 2-3, the maximum affected distance of the twisted-tape tube with 180° twisted angle is approximately from about 50D to 60D, wherein D is defined as inner diameter of radiant tube. The twisted-tape tube in the embodiment uses twisted ratio of 2.5 with a twisted angle of 180°.

In the prior art, without heat transfer intensifying members arranged in the radiant section of cracking furnace, the radiant tube always have certain temperature profile with a few extreme points. These extreme points refer to the maximum temperature of tube metal temperature at radiant tube wall. In general, each pass tube have a extreme point, for example as for the radiant tube type 2-1, its first pass tube has one extreme point, and second pass tube also has one extreme point, but the positions of the extreme points in two pass tubes are different. Normally, the positions of the extreme points would be fixed once cracking furnace structure is determined. All the factories using cracking furnace can offer the corresponding positions of the extreme points of the cracking furnace.

According to the cracking furnace of the present invention, the first twisted-tape tube is arranged at a location between 0 and 40D, preferably between 10 and 25D before the maximum temperature of tube metal temperature at each pass radiant tube; the second twisted-tape tube is arranged downstream the first twisted-tape tube, with a distance less than the "maximum affected distance Y" of the first one, preferably arranged between 0.7Y and 1.0Y; the third twisted-tape tube is arranged downstream the second twisted-tape tube, with a distance less than the "maximum affected distance Y" of the second one, preferably arranged between 0.7Y and 1.0Y; the arrangement of the forth one follows similar rule. In addition, the location of the last twisted-tape tube at each pass should not be less than 40D away from each pass tube end to meet mechanical strength requirement. When the radiant tube end couldn't be arranged with a twisted-tape tube any more, and if the other parameter especially the pressure drop could meet requirement, the twisted-tape tube might also be arranged before the first twisted-tape tube. The distance between this twisted-tape tube and the first twisted-tape tube should be less than the "maximum affected distance Y" of this twisted-tape tube, preferably arranged between 0.7Y and Y. If the radiant tube has several passes, each pass tube should follow same rule within each pass. However, the exact position of twisted-tape tube does not necessarily be the same. In addition, the total number of the twisted-tape tubes should still be determined with other parameters, for instance, especially pressure drop.

Figure 2:
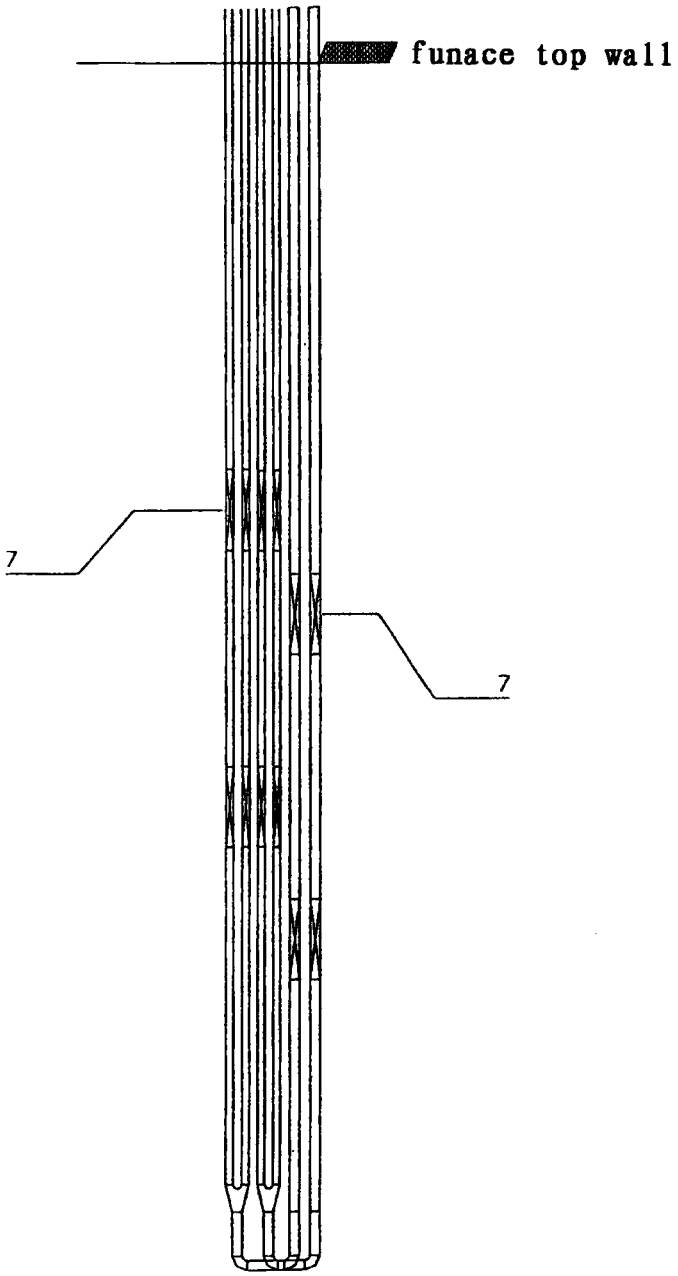
FIG. 2 is a schematic drawing of the radiant tubes arranged in the cracking furnace as shown in FIG. 1, in which two heat transfer intensifying members are arranged in every pass each tube, wherein the radiant tube uses tube type 2-1.
Figure 3:
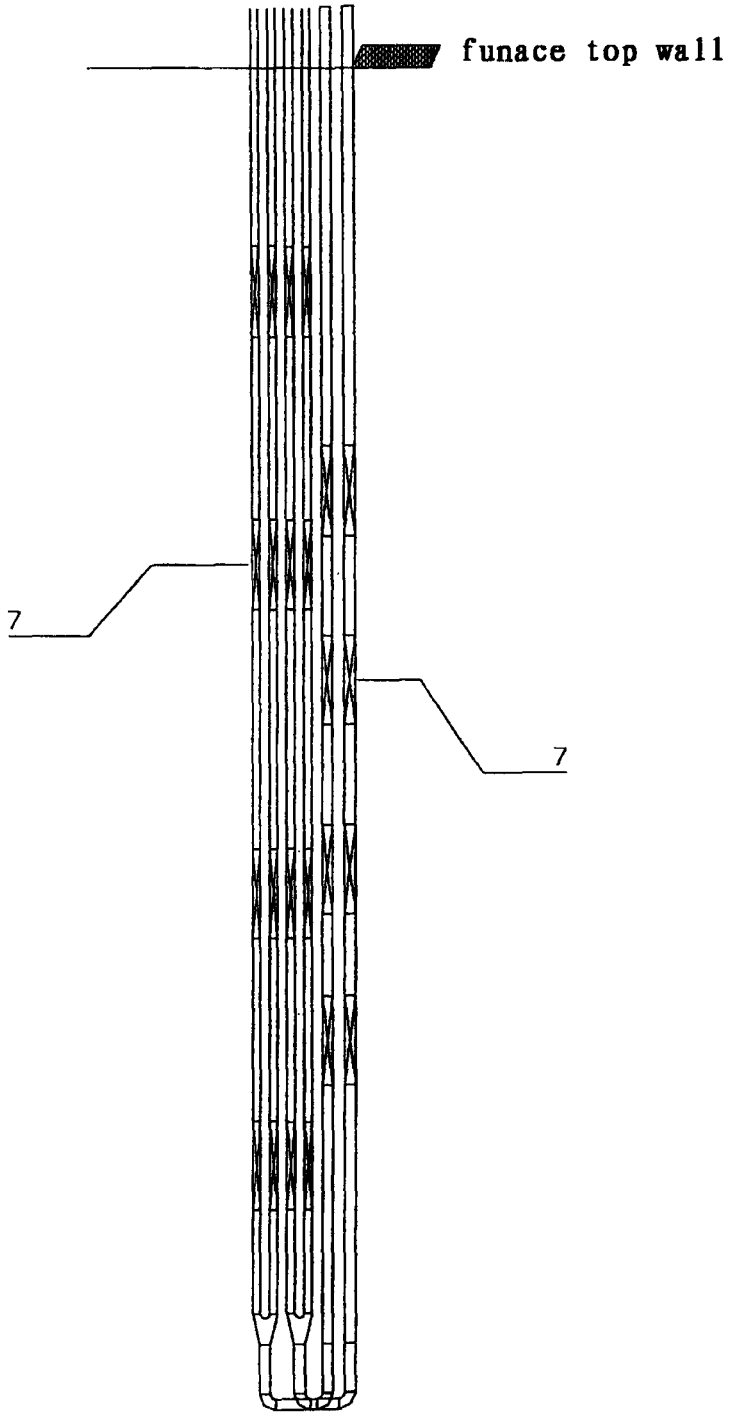
FIG. 3 is a schematic drawing of the radiant tubes arranged in the cracking furnace as shown in FIG. 1, in which 4 heat transfer intensifying members are arranged in every pass each tube, wherein the radiant tube uses tube type 2-1.
Figure 4:
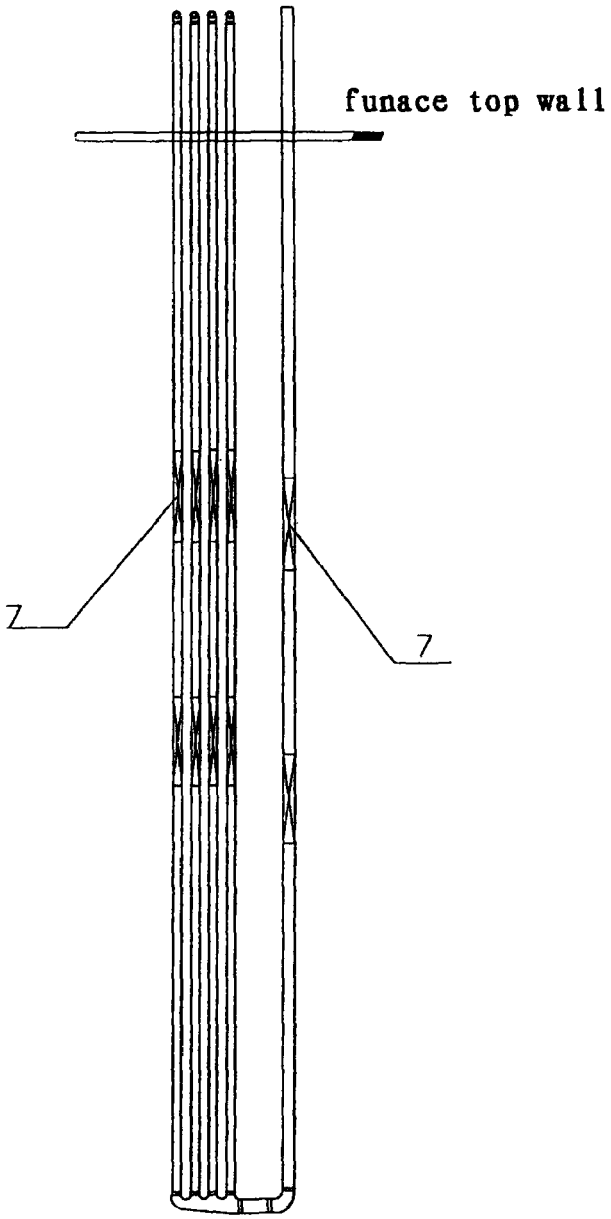
FIG. 4 is a schematic drawing of the radiant tubes arranged in the cracking furnace as shown in FIG. 1, in which 2 heat transfer intensifying members are arranged in every pass each tube, wherein the radiant tube uses tube type 4-1.

FIG. 2 shows two type 2-1 two pass radiant tubes. Each type 2-1 two pass radiant tube has two inlet legs and an outlet leg connected via a U bend. FIG. 4, on the other hand, shows a single type 4-1 two pass radiant tube. As shown, a type 4-23 1 two pass radiant tube has four inlet legs and one outlet leg connected via a U bend.

In the present invention, twisted-tape tubes are put on the most efficient points in cracking furnace. However it doesn't necessarily mean that all these points have to be arranged with twisted-tape tube, and also it does not necessarily mean that twisted-tape tubes could not be installed on other locations.

The present invention will be described further by way of examples in more details. However the present invention will not be limited by these examples. The scope of the present invention is described in the claims.

EXAMPLE 1

Figure 1:
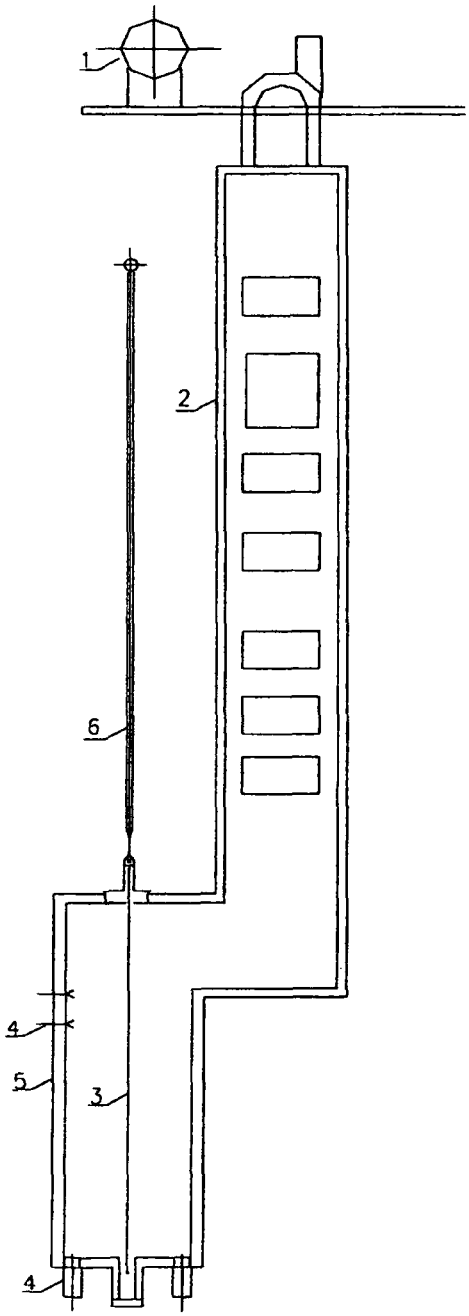
FIG. 1 is a schematic drawing of an ethylene cracking furnace using two pass radiant tube type 2-1 or type 4-1.

An ethylene cracking furnace using two pass radiant tubes type 2-1 (see FIG. 1), which comprises: a high pressure steam drum 1, a convection section 2, radiant tubes 3, burners 4, a radiant section 5, a quenching boiler 6. It has a yield of ethylene of 100 kilo-ton per year. The cracking material uses naphtha.

According to the difference between the pressure drop of the radiant tube by the end of run length and the allowable pressure drop limit, the number of twisted-tape tubes to be arranged is determined. Two heat transfer intensifying members 7 were arranged in each pass radiant tube, that is to say, each group of the radiant tube is totally provided with six heat transfer intensifying members 7 (see FIG. 2), wherein the heat transfer intensifying member is the twisted-tape tube. (see FIG. 5).

Project A: in the first pass radiant tube, a twisted-tape tube is arranged at a location which is 25 times the first pass radiant tube diameter D upstream of the extreme point of the first pass radiant tube metal temperature (TMT), namely the location of 25D. Another twisted-tape tube is arranged at a location which is 30 D downstream of the extreme point of the radiant tube metal temperature. In the second pass tube, a twisted-tape tube is arranged at a location which is 25 times the second pass radiant tube diameter D upstream of the extreme point of the second pass radiant tube metal temperature, namely the location of 25D. Another twisted-tape tube is arranged at a location which is 30 D downstream of the extreme point of the radiant tube metal temperature.

Project B: in the first pass radiant tube, a twisted-tape tube is arranged at a location which is 45 times the first pass radiant tube diameter D upstream of the extreme point of the first pass radiant tube metal temperature. Another twisted-tape tube is arranged at a location which is 10 D downstream of the extreme point of the radiant tube metal temperature. In the second pass tube, a twisted-tape tube is arranged at a location which is 45 times the second pass radiant tube diameter D upstream of the extreme point of the second pass radiant tube metal temperature. Another twisted-tape tube is arranged at a location which is 10 D downstream of the extreme point of the radiant tube metal temperature.

Project C: in the first pass radiant tube, a twisted-tape tube is arranged at a location which is 40 times the first pass radiant tube diameter D upstream of the extreme point of the first pass radiant tube metal temperature. Another twisted-tape tube is arranged at a location which is 15 D downstream of the extreme point of the first pass radiant tube metal temperature. In the second pass tube, a twisted-tape tube is arranged at a location which is 40 times the second pass radiant tube diameter D upstream of the extreme point of the second pass radiant tube metal temperature. Another twisted-tape tube is arranged at a location which is 15 D downstream of the extreme point of the second pass radiant tube metal temperature.

Project D: in the first pass tube, a twisted-tape tube is arranged at a location which is 35 times the first pass radiant tube diameter D upstream of the extreme point of first pass radiant tube metal temperature. Another twisted-tape tube is arranged at a location which is 20 D downstream of the extreme point of the first pass radiant tube metal temperature. In the second pass tube, a twisted-tape tube is arranged at a location which is 35 times the second pass radiant tube diameter D upstream of the extreme point of the second pass radiant tube metal temperature. Another twisted-tape tube is arranged at a location which is 20 D downstream of the extreme point of the second pass radiant tube metal temperature.

Project E: in the first pass radiant tube, a twisted-tape tube is arranged at a location which is 30 times first pass radiant tube diameter D upstream of the extreme point of the first radiant tube metal temperature. Another twisted-tape tube is arranged at a location which is 25 D downstream of the extreme point of the first pass radiant tube metal temperature. In the second pass tube, a twisted-tape tube is arranged at a location which is 30 times second pass radiant tube diameter D upstream of the extreme point of the second radiant tube metal temperature. Another twisted-tape tube is arranged at a location which is 25 D downstream of the extreme point of the second pass radiant tube metal temperature.

Project F: in the first pass radiant tube, a twisted-tape tube is arranged at a location which is 20 times first pass radiant tube diameter D upstream of the extreme point of first pass radiant tube metal temperature. Another twisted-tape tube is arranged at a location which is 35 D downstream of the extreme point of the first radiant tube metal temperature. In the second pass radiant tube, a twisted-tape tube is arranged at a location which is 20 times second pass radiant tube diameter D upstream of the extreme point of second pass radiant tube metal temperature. Another twisted-tape tube is arranged at a location which is 35 D downstream of the extreme point of the second radiant tube metal temperature Project G: in the first pass radiant tube, a twisted-tape tube is arranged at a location which is 15 times the first pass radiant tube diameter D upstream of the extreme point of the first pass radiant tube metal temperature. Another twisted-tape tube is arranged at a location which is 40 D downstream of the extreme point of the first pass radiant tube metal temperature. In the second pass tube, a twisted-tape tube is arranged at a location which is 15 times the second pass radiant tube diameter D upstream of the extreme point of the second pass radiant tube metal temperature. Another twisted-tape tube is arranged at a location which is 40 D downstream of the extreme point of the second pass radiant tube metal temperature.

Project H: in the first pass radiant tube, a twisted-tape tube is arranged at a location which is 10 times the first pass radiant tube diameter D upstream of the extreme point of the first radiant tube metal temperature. Another twisted-tape tube is arranged at a location which is 45 D downstream of the extreme point of the radiant tube metal temperature. In the second pass tube, a twisted-tape tube is arranged at a location which is 10 times the second pass radiant tube diameter D upstream of the extreme point of the second radiant tube metal temperature. Another twisted-tape tube is arranged at a location which is 45 D downstream of the extreme point of the radiant tube metal temperature.

Project I: in the first pass radiant tube, a twisted-tape tube is arranged at a location which is 5 times the first pass radiant tube diameter D upstream of the extreme point of the first radiant tube metal temperature. Another twisted-tape tube is arranged at a location which is 50 D downstream of the extreme point of the radiant tube metal temperature. In the second pass tube, a twisted-tape tube is arranged at a location which is 5 times the second pass radiant tube diameter D upstream of the extreme point of the second radiant tube metal temperature. Another twisted-tape tube is arranged at a location which is 50 D downstream of the extreme point of the radiant tube metal temperature.

The above-mentioned projects are shown in the tablet 1.

Tablet 1 different locations of the twisted-tape tube of each project

| | The location of twisted-tape tube in the first pass | | The location of twisted-tape tube in the second pass | |
|---|---|---|---|---|
| | upstream of the maximum temperature of TMT | downstream of the maximum temperature of TMT | upstream of the maximum temperature of TMT | downstream of the maximum temperature of TMT |
| Project A | 25 | 30 | 25 | 30 |
| Project B | 45 | 10 | 45 | 10 |
| Project C | 40 | 15 | 40 | 15 |
| Project D | 35 | 20 | 35 | 20 |
| Project E | 30 | 25 | 30 | 25 |
| Project F | 20 | 35 | 20 | 35 |
| Project G | 15 | 40 | 15 | 40 |
| Project H | 10 | 45 | 10 | 45 |
| Project I | 5 | 50 | 5 | 50 |

By comparing the operation parameters of the cracking furnace provided with twisted-tape tubes according to different projects (see tablets 2, 3), under the same operation condition, it is found that all the cracking furnace of nine projects reach to the end of the "run length" due to the fact that the radiant tube wall temperature is finally higher than the maximum temperature of TMT, at the same time the pressure drop of the radiant tube don't reach the operation limit. The effect of projects A, F, G, H are much better than the others (A is the best), since the run length of the cracking furnace is lengthened obviously. In the tablets, SOR stands for the start of run of cracking furnace, EOR stands for the end of run of cracking furnace.

Tablet 2 contrasts of all kinds of projects

| | Project A | | Project B | | Project C | |
|---|---|---|---|---|---|---|
| | SOR | EOR | SOR | EOR | SOR | EOR |
| Feed rate (T/h) | 41.2 | 41.2 | 41.2 | 41.2 | 41.2 | 41.2 |
| steam to oil ratio | 0.5 | 0.5 | 0.5 | 0.5 | 0.5 | 0.5 |
| COT(coil outlet temperature)(° C.) | 830 | 830 | 830 | 830 | 830 | 830 |

-continued

Tablet 2 contrasts of all kinds of projects

| | Project A | | Project B | | Project C | |
|---|---|---|---|---|---|---|
| | SOR | EOR | SOR | EOR | SOR | EOR |
| Impact on run length | TMT | | TMT | | TMT | |
| Run length(day) | 56 | | 41 | | 44 | |

Tablet 3 contrasts of all kinds of projects

| | Project D | | Project E | | Project F | |
|---|---|---|---|---|---|---|
| | SOR | EOR | SOR | EOR | SOR | EOR |
| Feed rate (T/h) | 41.2 | 41.2 | 41.2 | 41.2 | 41.2 | 41.2 |
| steam to oil ratio | 0.5 | 0.5 | 0.5 | 0.5 | 0.5 | 0.5 |

-continued

Tablet 3 contrasts of all kinds of projects

| | Project D | | Project E | | Project F | |
|---|---|---|---|---|---|---|
| | SOR | EOR | SOR | EOR | SOR | EOR |
| COT(coil outlet temperature)(° C.) | 830 | 830 | 830 | 830 | 830 | 830 |
| Impact on run length | TMT | | TMT | | TMT | |
| run length(day) | 46 | | 48 | | 54 | |

Tablet 4 contrasts of all kinds of projects

| | Project G | | Project H | | Project I | |
|---|---|---|---|---|---|---|
| | SOR | EOR | SOR | EOR | SOR | EOR |
| Feed rate (T/h) | 41.2 | 41.2 | 41.2 | 41.2 | 41.2 | 41.2 |
| steam to oil ratio | 0.5 | 0.5 | 0.5 | 0.5 | 0.5 | 0.5 |
| COT(coil outlet temperature)(° C.) | 830 | 830 | 830 | 830 | 830 | 830 |

-continued

Tablet 4 contrasts of all kinds of projects

| | Project G | | Project H | | Project I | |
|---|---|---|---|---|---|---|
| | SOR | EOR | SOR | EOR | SOR | EOR |
| Impact on run length | TMT | | TMT | | TMT | |
| Run length(day) | 52 | | 49 | | 42 | |

EXAMPLE 2

An ethylene cracking furnace using two pass radiant tubes type 4-1 (see FIG. 1), which comprises: a high pressure steam drum 1, a convection section 2, a radiant tube 3, burners 4, a radiant section 5, a quenching boiler 6. It has a yield of ethylene of 100 kilo-ton per year. The radiant tube 3 of this example is two pass radiant tube type 4-1. The cracking material uses naphtha.

According to the difference between the pressure drop of the radiant tube by the end of the run length and allowable pressure drop limit, the number of twisted-tape tubes to be arranged is determined. Two heat transfer intensifying members 7 are arranged in each pass radiant tube, that is to say, each group of the radiant tubes is totally provided with ten heat transfer intensifying members 7 (see FIG. 2), wherein the heat transfer intensifying member is the twisted-tape tube (see FIG. 5).

Project A: in the first pass radiant tube, a twisted-tape tube is arranged at a location which is 25 times the first radiant tube diameter D upstream of the extreme point of the first radiant tube metal temperature, namely the location of 25D. Another twisted-tape tube is arranged at a location which is 30 D downstream of the extreme point of first radiant tube metal temperature. In the second pass tube, a twisted-tape tube is arranged at a location which is 25 times the second radiant tube diameter D upstream of the extreme point of the second radiant tube metal temperature, namely the location of 25D. Another twisted-tape tube is arranged at a location which is 30 D downstream of the extreme point of second radiant tube metal temperature.

Project B: in the first pass tube, a twisted-tape tube is arranged at a location which is 45 times the first radiant tube diameter D upstream of the extreme point of the first radiant tube metal temperature. Another twisted-tape tube is arranged at a location which is 10 D downstream of the extreme point of the first pass radiant tube metal temperature. In the second pass tube, a twisted-tape tube is arranged at a location which is 45 times the second radiant tube diameter D upstream of the extreme point of the second radiant tube metal temperature. Another twisted-tape tube is arranged at a location which is 10 D downstream of the extreme point of the second pass radiant tube metal temperature.

Project C: in the first pass tube, a twisted-tape tube is arranged at a location which is 40 times the first radiant tube diameter D upstream of the extreme point of the first radiant tube metal temperature. Another twisted-tape tube is arranged at a location which is 15 D downstream of the extreme point of the first radiant tube metal temperature. In the second pass tube, a twisted-tape tube is arranged at a location which is 40 times the second radiant tube diameter D upstream of the extreme point of the second radiant tube metal temperature. Another twisted-tape tube is arranged at a location which is 15 D downstream of the extreme point of the second radiant tube metal temperature.

Project D: in the first pass radiant tube, a twisted-tape tube is arranged at a location which is 35 times the first radiant tube diameter D upstream of the extreme point of the first pass radiant tube metal temperature. Another twisted-tape tube is arranged at a location which is 20 D downstream of the extreme point of the first radiant tube metal temperature. In the second pass tube, a twisted-tape tube is arranged at a location which is 35 times the second radiant tube diameter D upstream of the extreme point of the second pass radiant tube metal temperature. Another twisted-tape tube is arranged at a location which is 20 D downstream of the extreme point of the second radiant tube metal temperature.

Project E: in the first pass radiant tube, a twisted-tape tube is arranged at a location which is 30 times the first pass radiant tube diameter D at a distance of the extreme point of the first pass radiant tube metal temperature. Another twisted-tape tube is arranged at a location which is 25 D downstream of the extreme point of the first pass radiant tube metal temperature. In the second pass tube, a twisted-tape tube is arranged at a location which is 30 times the second pass radiant tube diameter D at a distance of the extreme point of the second pass radiant tube metal temperature. Another twisted-tape tube is arranged at a location which is 25 D downstream of the extreme point of the second pass radiant tube metal temperature.

Project F: in the first pass tube, a twisted-tape tube is arranged at a location which is 20 times the first pass radiant tube diameter D upstream of the extreme point of the first pass radiant tube metal temperature. Another twisted-tape tube is arranged at a location which is 35 D downstream of the extreme point of the first pass radiant tube metal temperature. In the second pass tube, a twisted-tape tube is arranged at a location which is 20 times the second pass radiant tube diameter D upstream of the extreme point of the second pass radiant tube metal temperature. Another twisted-tape tube is arranged at a location which is 35 D downstream of the extreme point of the second pass radiant tube metal temperature.

Project G: in the first pass radiant tube, a twisted-tape tube is arranged at a location which is 15 times the first pass radiant tube diameter D upstream of the extreme point of the first pass radiant tube metal temperature. Another twisted-tape tube is arranged at a location which is 40 D downstream of the extreme point of the first radiant tube metal temperature. In the second pass tube, a twisted-tape tube is arranged at a location which is 15 times the second pass radiant tube diameter D upstream of the extreme point of the second pass radiant tube metal temperature. Another twisted-tape tube is arranged at a location which is 40 D downstream of the extreme point of the second radiant tube metal temperature.

Project H: in the first pass radiant tube, a twisted-tape tube is arranged at a location which is 10 times the first pass radiant tube diameter D upstream of the extreme point of the first pass radiant tube metal temperature. Another twisted-tape tube is arranged at a location which is 45 D downstream of the extreme point of the first pass radiant tube metal temperature. In the second pass tube, a twisted-tape tube is arranged at a location which is 10 times the second pass radiant tube diameter D upstream of the extreme point of the second pass radiant tube metal temperature. Another twisted-tape tube is arranged at a location which is 45 D downstream of the extreme point of the second pass radiant tube metal temperature.

Project I: in the first pass radiant tube, a twisted-tape tube is arranged at a location which is 5 times the first pass radiant tube diameter D upstream of the extreme point of the first pass radiant tube metal temperature. Another twisted-tape tube is arranged at a location which is 50 D downstream of the extreme point of the first pass radiant tube metal temperature. In the second pass tube, a twisted-tape tube is arranged at a location which is 5 times the second pass radiant tube diameter D upstream of the extreme point of the second pass radiant tube metal temperature. Another twisted-tape tube is arranged at a location which is 50 D downstream of the extreme point of the second pass radiant tube metal temperature.

The above-mentioned projects are shown in the tablet 5.

Tablet 5 different locations of the twisted-tape tubes of each project

| | The location of twisted-tape tube in the first pass | | The location of twisted-tape tube in the second pass | |
|---|---|---|---|---|
| | upstream of the maximum temperature of TMT | downstream of the maximum temperature of TMT | upstream of the maximum temperature of TMT | downstream of the maximum temperature of TMT |
| Project A | 25 | 30 | 25 | 30 |
| Project B | 45 | 10 | 45 | 10 |
| Project C | 40 | 15 | 40 | 15 |
| Project D | 35 | 20 | 35 | 20 |
| Project E | 30 | 25 | 30 | 25 |
| Project F | 20 | 35 | 20 | 35 |
| Project G | 15 | 40 | 15 | 40 |
| Project H | 10 | 45 | 10 | 45 |
| Project I | 5 | 50 | 5 | 50 |

By comparing the operation parameters of the cracking furnace provided with twisted-tape tubes according to different projects (see tablet 6, 7, 8), under the same operation condition, it is found that the effect of projects A, F, G, H is much better than the others (F is the best). This is because that the maximum temperature of the radiant tube wall decreased obviously at SOR. The TMT at SOR decreased enormously, it indicates that there are more space between the TMT at SOR and the TMT (1125° C.) at EOR, in other words, the run length of the cracking furnace is longer.

Tablet 6 contrast of all kinds of projects

| | Project A | | Project B | | Project C | |
|---|---|---|---|---|---|---|
| | SOR | EOR | SOR | EOR | SOR | EOR |
| Feed rate (T/h) | 41.2 | 41.2 | 41.2 | 41.2 | 41.2 | 41.2 |
| steam to oil ratio | 0.5 | 0.5 | 0.5 | 0.5 | 0.5 | 0.5 |
| COT(coil outlet temperature) (° C.) | 830 | 830 | 830 | 830 | 830 | 830 |
| the maximum tube metal temperature at SOR(° C.) | BASE | | +13 | | +10 | |

Tablet 7 contrast of all kinds of projects

| | Project D | | Project E | | Project F | |
|---|---|---|---|---|---|---|
| | SOR | EOR | SOR | EOR | SOR | EOR |
| Feed rate (T/h) | 41.2 | 41.2 | 41.2 | 41.2 | 41.2 | 41.2 |
| steam to oil ratio | 0.5 | 0.5 | 0.5 | 0.5 | 0.5 | 0.5 |

-continued

Tablet 7 contrast of all kinds of projects

| | Project D | | Project E | | Project F | |
|---|---|---|---|---|---|---|
| | SOR | EOR | SOR | EOR | SOR | EOR |
| COT(coil outlet temperature)(° C.) | 830 | 830 | 830 | 830 | 830 | 830 |

-continued

Tablet 7 contrast of all kinds of projects

| | Project D | | Project E | | Project F | |
|---|---|---|---|---|---|---|
| | SOR | EOR | SOR | EOR | SOR | EOR |
| the maximum tube metal temperature at SOR (° C.) | +8 | | +2 | | −2 | |

Tablet 8 contrast of all kinds of projects

| | Project G | | Project H | | Project I | |
|---|---|---|---|---|---|---|
| | SOR | EOR | SOR | EOR | SOR | EOR |
| Feed rate (T/h) | 41.2 | 41.2 | 41.2 | 41.2 | 41.2 | 41.2 |
| steam to oil ratio | 0.5 | 0.5 | 0.5 | 0.5 | 0.5 | 0.5 |
| COT(coil outlet temperature)(° C.) | 830 | 830 | 830 | 830 | 830 | 830 |
| the maximum tube metal temperature at SOR (° C.) | 0 | | +2 | | +8 | |

EXAMPLE 3

An ethylene cracking furnace using two pass radiant tubes type 2-1 (see FIG. 1), which comprises a high pressure steam drum 1, a convection section 2, a radiant tube 3, burners 4, a radiant section 5, a quenching boiler 6. It has a yield of ethylene of 60 kilo-ton per year. The cracking material uses naphtha.

According to the difference between the pressure drop of the radiant tube by the end of the run length and allowable pressure drop limit, the number of twisted-tape tubes to be arranged is determined. Two heat transfer intensifying members 7 are arranged in each pass radiant tube, that is to say, each group of the radiant tubes is totally provided with six heat transfer intensifying members 7 (see FIG. 2), wherein the heat transfer intensifying member is the twisted-tape tube (see FIG. 5).

Project A: in the first pass radiant tube, a twisted-tape tube is arranged at a location which is 25 times the first pass radiant tube diameter D upstream, of the extreme point of the first pass radiant tube metal temperature, namely the location of 25D. Another twisted-tape tube is arranged at a location which is 30 D downstream of the extreme point of the first pass radiant tube metal temperature. In the second pass tube, a twisted-tape tube is arranged at a location which is 25 times the second pass radiant tube diameter D upstream of the extreme point of the second pass radiant tube metal temperature, namely the location of 25D. Another twisted-tape tube is arranged at a location which is 30 D downstream of the extreme point of the second pass radiant tube metal temperature.

Project B: in the first pass radiant tube, a twisted-tape tube is arranged at a location which is 45 times the first pass radiant tube diameter D upstream of the extreme point of the first pass radiant tube metal temperature. Another twisted-tape tube is arranged at a location which is 60 D downstream of the extreme point of the first pass radiant tube metal temperature. In the second pass tube, a twisted-tape tube is arranged at a location which is 45 times the second pass radiant tube diameter D upstream of the extreme point of the second pass radiant tube metal temperature. Another twisted-tape tube is arranged at a location which is 60 D downstream of the extreme point of the second pass radiant tube metal temperature.

Compared the cracking furnaces using Project A and B, it is found that the run length increased by big percentages under the regular processing load. (see tablet 9)

When the processing load of cracking furnace is increased by 7%, compared the ethylene cracking furnaces using two different projects, it is found that the run length of the cracking furnace using project A of the present invention is longer than that of project B under the same other conditions (see tablet 10).

It is observed from tablets 9 and 10 that the run length of the cracking furnace improved by using project A of the present invention is longer than that of the cracking furnace using project B with regular processing load, even if the processing load of the cracking furnace improved by using project A is increased by 7%.

Tablet 9 contrast of all kinds of projects

| | Project B | | Project A | |
|---|---|---|---|---|
| | SOR | EOR | SOR | EOR |
| Feed rate (T/h) | 25.6 | 25.6 | 25.6 | 25.6 |
| steam to oil ratio | 0.7 | 0.7 | 0.7 | 0.7 |
| COT(coil outlet temperature)(° C.) | 830 | 830 | 830 | 830 |

-continued

Tablet 9 contrast of all kinds of projects

| | Project B | | Project A | |
|---|---|---|---|---|
| | SOR | EOR | SOR | EOR |
| Impact on run length | TMT | | TMT | |
| Run length (day) | 40 | | 60 | |

Tablet 10 contrast of all kinds of projects

| | Project B | | Project A | |
|---|---|---|---|---|
| | SOR | EOR | SOR | EOR |
| Feed rate (T/h) | 27 | 27 | 27 | 27 |
| steam to oil ratio | 0.7 | 0.7 | 0.7 | 0.7 |
| COT(coil outlet temperature)(° C.) | 830 | 830 | 830 | 830 |
| Impact on run length | TMT | | TMT | |
| run length (day) | 35 | | 54 | |

EXAMPLE 4

An ethylene cracking furnace using two pass radiant tubes type 2-1 (see FIG. 1), which comprises a high pressure steam drum 1, a convection section 2, a radiant tube 3, burners 4, a radiant section 5, a quenching boiler 6, of which the radiant tube includes 48 groups of type 2-1 tubes. It has the yield of ethylene of 100 kilo-ton ethylene per year. The cracking material uses naphtha.

As is shown in FIG. 2, four heat transfer intensifying members Tare arranged in radiant tube 3 along the fluid flowing direction, wherein the heat transfer intensifying member is the twisted-tape tube as shown in FIG. 5.

In the first pass tube, a twisted-tape tube is arranged at a location which is 25 times the first pass radiant tube diameter D upstream of the extreme point of the first pass radiant tube metal temperature. Another twisted-tape tube is arranged at a location which is 30 D downstream of the extreme point of the first pass radiant tube metal temperature. In the second pass tube, a twisted-tape tube is arranged at a location which is 25 times the second pass radiant tube diameter D upstream of the extreme point of the second pass radiant tube metal temperature. Another twisted-tape tube is arranged at a location which is 30 D downstream of the extreme point of the second pass radiant tube metal temperature.

"before improvement" is the example of the conventional cracking furnace without heat transfer intensifying members, "after improvement" is the example of the cracking furnace provided with the heat transfer intensifying member by the present method. By comparing the parameters of two cracking furnaces under the same operation condition, it is found that the run length is lengthened substantially and the fuel rate is reduced a little after the cracking furnace is provided with the twisted-tape tubes.

Tablet 11 contrast of the cracking furnaces

| | | before improvement | | after improvement | | |
|---|---|---|---|---|---|---|
| | | SOR | EOR | SOR | the 39$^{th}$ day | EOR |
| Feed rate (kg/h) | | 46 | 41.2 | 46.0 | 41.2 | 41.2 |
| Steam to oil ratio | | 0.75 | 0.75 | 0.75 | 0.75 | 0.75 |
| Fuel rate (kg/h) | hearth burner | 7140 | 7672.9 | 6724.4 | 7202.0 | 7178.5 |
| | wall burner | 1650 | 1687.8 | 1650.0 | 1700.0 | 1650 |
| | SUM | 8790 | 9360.7 | 8374.4 | 8902 | 8828.5 |
| run length (day) | | 38 | | | 56 | |

The invention claimed is:

1. A tubular cracking furnace, comprising:

a convection section;

a radiant section; and a radiant tube arranged in the radiant section, wherein the radiant tube has an extreme point corresponding to a location of peak temperature along the radiant tube, wherein the radiant tube comprises a first heat transfer intensifying member at a location being at a distance of within 40D upstream of the extreme point, and wherein D is an inner diameter of the radiant tube.

2. The tubular cracking furnace of claim 1, wherein the location of the first heat transfer intensifying member is at a distance of 10D to 25D upstream of the extreme point.

3. The tubular cracking furnace of claim 1, wherein the radiant tube further comprises at least one additional heat transfer intensifying member downstream from the first heat transfer intensifying member.

4. The tubular cracking furnace of claim 3, wherein the additional heat transfer intensifying member is located at a distance of less than Y downstream from the first heat transfer intensifying member, wherein Y is a maximum affected distance of the first heat transfer intensifying member.

5. The tubular cracking furnace of claim 3, wherein the additional heat transfer intensifying member is located at a distance of more than 0.7Y downstream from the first heat transfer intensifying member, wherein Y is a maximum affected distance of the first heat transfer intensifying member.

6. The tubular cracking furnace of claim 3, wherein the radiant tube further comprises three additional heat transfer intensifying members downstream from the first heat transfer intensifying member, each adjacent pair of the three additional heat transfer intensifying members being spaced apart by less than a maximum affected distance of an upstream additional heat transfer intensifying member in the pair.

7. The tubular cracking furnace of claim 1, wherein the heat transfer intensifying member comprises a twisted-tape tube.

8. The tubular cracking furnace of claim 7, wherein the twisted-tape tube has a twist ratio ranging from 2 and 3 and a twisted angle of 180°.

9. The tubular cracking furnace of claim 8, wherein a maximum affected distance of the twisted-tape tube is between about 50D and 60D.

10. The tubular cracking furnace of claim 1, wherein the radiant tube is a type 2-1 radiant tube, comprising two inlet legs and one outlet leg.

11. The tubular cracking furnace of claim 10, wherein only the outlet leg of the radiant tube comprises at least one heat transfer intensifying member.

12. The tubular cracking furnace of claim 10, wherein each of the inlet legs and the outlet leg of the radiant tube comprises at least one heat transfer intensifying member.

13. The tubular cracking furnace of claim 7, wherein the radiant tube is a type 4-1 radiant tube, comprising four inlet legs and one outlet leg.

14. The tubular cracking furnace of claim 13, wherein only the outlet leg of the radiant tube comprises at least one heat transfer intensifying member.

15. The tubular cracking furnace of claim 13, wherein each of the inlet legs and the outlet leg of the radiant tube comprises at least one heat transfer intensifying member.

16. The tubular cracking furnace of claim 1, wherein the radiant tube is a single pass tube.

17. The tubular cracking furnace of claim 1, wherein the tubular cracking furnace is an ethylene cracking furnace.

18. A method for reducing wall temperature of a radiant tube in a tubular cracking furnace, comprising:

identifying an extreme point corresponding to a location of peak temperature along the radiant tube; and installing a first heat intensifying member in the radiant tube at a location being at a distance of within 40D upstream of the extreme point, wherein D is an inner diameter of the radiant tube.

19. The method of claim 18, wherein the location of the first heat transfer intensifying member is at a distance of 10D to 25D upstream of the extreme point.

20. The method of claim 19, further comprising installing at least one additional heat transfer intensifying member in the radiant tube.

21. The method of claim 18, wherein the heat transfer intensifying member comprises a twisted-tape tube.

22. The method of claim 18, wherein the tubular cracking furnace is an ethylene cracking furnace.

* * * * *